United States Patent [19]

Annowsky

[11] Patent Number: 4,574,400

[45] Date of Patent: Mar. 11, 1986

[54] DIRT TRAP FOR FLUSH BASINS

[76] Inventor: Wolfgang Annowsky, Erlenstrasse 82, Wollerau, Switzerland

[21] Appl. No.: 674,787

[22] Filed: Nov. 26, 1984

[30] Foreign Application Priority Data

Dec. 1, 1983 [DE] Fed. Rep. of Germany ... 8334567[U]

[51] Int. Cl.[4] ..... E03D 9/02

[52] U.S. Cl. ..... 4/222.1; 4/309; 4/286; 4/290; 4/294

[58] Field of Search ..... 4/309, 222, 222.1, 294, 4/286–292, 261

[56] References Cited

U.S. PATENT DOCUMENTS

| | | | |
|---|---|---|---|
| 1,880,962 | 10/1932 | Koppalman | 4/309 |
| 1,966,074 | 7/1934 | Fuld | 4/309 |
| 2,046,214 | 6/1936 | Selig | 4/222.1 |
| 2,059,524 | 11/1936 | Hoffman | 4/222.1 |
| 2,087,341 | 7/1937 | Farmar | 4/222.1 |
| 4,135,261 | 1/1979 | Uhrman | 4/309 X |

FOREIGN PATENT DOCUMENTS

| | | | |
|---|---|---|---|
| 625952 | 10/1981 | Switzerland | 4/222.1 |

*Primary Examiner*—Henry R. Artis

*Attorney, Agent, or Firm*—Walter C. Farley

[57] ABSTRACT

A dirt trap for flush basins such as urinals include a perforated base plate and a central projection which receives a basket. The basket includes upwardly extending arms joined together at a location spaced upwardly from the base plate by a connecting ring, the distal ends of the arms being bent inwardly and downwardly toward the central axis of the basket. A weight is provided in the base plate to maintain the position of the dirt trap during flushing.

12 Claims, 3 Drawing Figures

DIRT TRAP FOR FLUSH BASINS

This invention relates to a dirt trap for a flush basin, such as a urinal, of the type having a water drain.

BACKGROUND OF THE INVENTION

It is known to provide protection for the drain of a flush basin, particularly a urinal, to prevent blockages by objects which have been thrown into the basin such as cigarette butts or other objects. Commonly, this protection is provided by inserting a perforated plate made from metal or plastic. A disadvantage of the usual perforated plate is that water which flows into the basin during flushing can move the plate from its protective location so that objects thrown into the basin can still enter the drain and block it. A further disadvantage exists with certain kinds of dirt traps which are provided with a container for receiving a fragrant, vaporizable or soluble body of material which is provided for disinfection and improving the smell. In such devices, the dirt trap must be removed and a separate container removed in order to permit the insertion of a new body of fragrant material.

SUMMARY OF THE INVENTION

An objective of the present invention is to provide an improved dirt trap in which it is possible to replace the fragrant body of material without removing the dirt trap.

A further objective is to provide a dirt trap which remains in its protective position despite the flow of flushing water.

Briefly described, the invention comprises a dirt trap for flush basins of the type having a water drain comprising a base plate having a plurality of openings therethrough, the base plate being positionable over the water drain in a generally horizontal position, and a basket mounted on the base plate for receiving a body of fragrant material, the basket having a plurality of individual arms extending upwardly away from the plate.

In order to impart a full understanding of the manner in which these and other objectives are attained in accordance with the invention, a particularly advantageous embodiment thereof will be described with reference to the accompanying drawings, which form a part of this specification, and wherein.

DESCRIPTION OF THE PREFERRED EMBODIMENT

Figure 3:
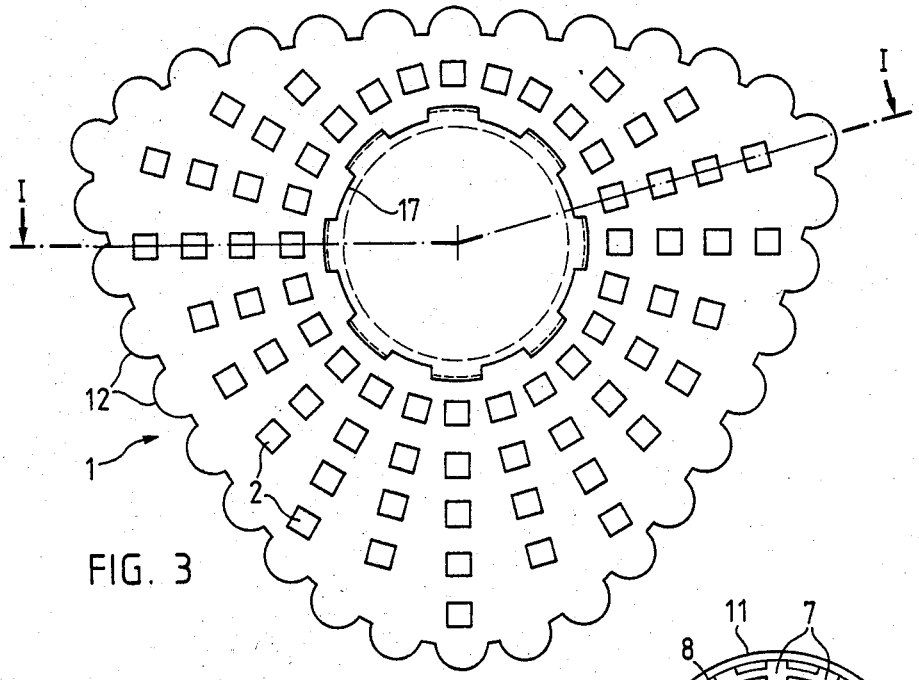
FIG. 3 is a bottom plan view of the dirt trap base plate from the direction indicated as III in FIG. 1.
Figure 2:
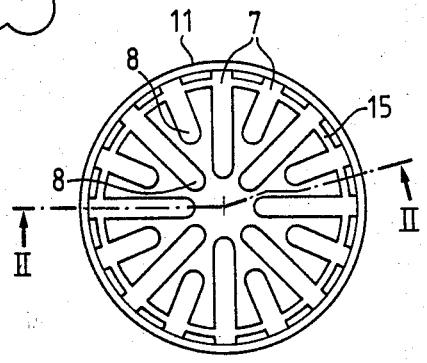
FIG. 2 is a top plan view of the basket portion of the apparatus of FIG. 1.
Figure 1:
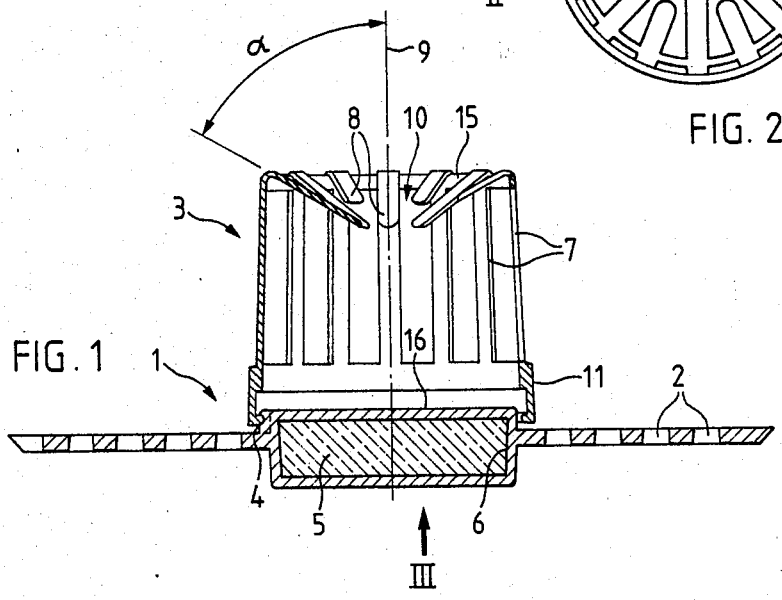
FIG. 1 is a side elevation, in section, of a dirt trap and basket assembly in accordance with the invention, the section being taken along lines I—I of FIG. 3 and II—II of FIG. 2.

FIGS. 1, 2 and 3 illustrate a dirt trap in accordance with the invention which comprises a base plate 1 and a basket 3. The base plate is provided with a central projection 16 protruding upwardly from the base plate and the basket is mounted on projection 16. A generally annular groove 4 is provided around the periphery of projection 16 to receive one or more protrusions on basket 3 to latch the two members together. The periphery of projection 16 is also provided with a plurality of radially inwardly extending recesses which form passages for draining liquid from the interior of basket 3. Base plate 1 has a plurality of perforations or passage openings 2 the size of which is selected so that any solid objects thrown into the flush basin cannot pass through the openings into the flush basin drain.

In the central region of base plate 1, a cavity 6 is provided for receiving a weight 5 which prevents any displacement of the dirt trap during flushing. Weight 5 is preferably made from lead and can be positioned generally over the drain.

Basket 3 is provided with a circular, annular rim 11 from which a plurality of arms 7 extend upwardly away from the base plate. Arms 7 are interconnected by a connecting ring 5 which is spaced upwardly from rim 11 and plate 1. However, the arms have free end portions 8 which are bent inwardly so that they extend toward the central axis 9 of basket 3 and slope at an angle $\alpha$ of about 30° relative to the axis 9 of the basket and of base plate 1 as illustrated in FIG. 1. Ends 8 do not extend completely to the basket axis 9 but, rather, leave a free passage 10 open. A body or block of fragrant material can be inserted into basket 3 by pushing it through passage 10 without the necessity of removing basket 3 from base plate 1. Nevertheless, the fragrant block cannot be washed out of basket 3 even if there is a powerful surge of water during flushing.

The free ends 8 of arms 7 are preferably of unequal length. Due to the fact that the free ends 8 are not connected with each other, they are sufficiently flexible, particularly when they are made from plastic or metal, such that a fragrant block which has larger dimensions than the diameter of passage 10 can be placed in basket 3 simply by pushing the block through.

The contour of base plate 1 is appropriately adapted to the shape of the flush basin and can be generally oval or polygonal, particularly triangular or quadrangular. The edge 12 of base plate 1 can have projections so that there are openings for the passage of water adjacent the surface of the flush basin.

It is very easy to work with this dirt trap. If a fragrant block previously placed in basket 3 has dissolved, a new block can be inserted through the free opening 10 in the cover of basket 3 and it is not necessary to remove the trap from the flush basin in order to accomplish this. Only if foreign bodies or other objects of various types have collected on base plate 1 is it necessary to remove, rinse, and clean the dirt trap. Also, basket 3 can be separated from base plate 1, this being advantageous if it is necessary to replace a broken basket or to clean from the basket materials which have been placed therein other than the fragrant block.

While one advantageous embodiment has been chosen to illustrate the invention, it will be understood by those skilled in the art that various changes and modifications can be made therein without departing from the scope of the invention as defined in the appended claims.

I claim:

1. A dirt trap for flush basins of the type having a water drain comprising a base plate having a plurality of openings therethrough, said base plate being positionable over the water drain in a generally horizontal position;

a basket mounted on said base plate for receiving a body of fragrant material, said basket having a plurality of individual arms extending upwardly away from said plate; and an interconnecting ring joining said arms together, said ring being spaced upwardly from said base plate, the ends of said arms defining a central passage through which a body of fragrant material can be inserted into the basket.

2. A dirt trap according to claim 1, wherein the distal upper ends of said arms are bent inwardly and extend toward the central axis of said basket.

3. A dirt trap according to claim 2, wherein the ends of said arms form a predetermined acute angle relative to the upwardly extending portions thereof.

4. A dirt trap according to claim 3, wherein said angle is approximately 30 degrees.

5. A dirt trap according to claim 1, wherein the distal upper ends of said arms are bent inwardly and extend toward the central axis of said basket.

6. A dirt trap according to claim 5, wherein the ends of said arms are of unequal lengths.

7. A dirt trap according to claim 1, wherein said base plate has a polygonal contour adapted to the internal shape of the flush basin.

8. A dirt trap according to claim 1, wherein said base plate has an oval contour adapted to the interior shape of the flush basin.

9. A dirt trap according to claim 1, wherein said base plate includes a central projection on which said basket is mounted, the rim of said central projection comprising a plurality of radially inwardly extending recesses.

10. A dirt trap for flush basins of the type having a water drain comprising a base plate having a plurality of openigns therethrough, said base plate being positionable over the water drain in a generally horizontal position;

a basket mounted on said base plate for receiving a body of fragrant material, said basket having a plurality of individual arms extending upwardly away from said plate; and an interconnecting ring joining said arms together, said ring being spaced upwardly from said base plate;

and wherein the distal upper ends of said arms are bent inwardly to form a predetermined angle relative to said base plate and extend toward the central axis of said basket, the ends of said arms defining a central passage through which a body of fragrant material can be inserted into the basket.

11. A dirt trap according to claim 10 wherein the ends of said arms are of unequal lengths.

12. A dirt trap according to claim 11, wherein said base plate includes a substantially centrally located weight.

* * * * *